United States Patent [19]

Roberts

[11] 4,437,041

[45] Mar. 13, 1984

[54] AMALGAM HEATING SYSTEM FOR SOLENOIDAL ELECTRIC FIELD LAMPS

[75] Inventor: Victor D. Roberts, Burnt Hills, N.Y.

[73] Assignee: General Electric Company, Schenectady, N.Y.

[21] Appl. No.: 320,254

[22] Filed: Nov. 12, 1981

[51] Int. Cl.[3] ..... H05B 41/16; H05B 41/24

[52] U.S. Cl. ..... 315/248; 313/490; 313/547; 313/550; 315/39

[58] Field of Search ..... 315/248, 39; 313/547, 313/550, 490

[56] References Cited

U.S. PATENT DOCUMENTS

| | | | |
|---|---|---|---|
| 1,698,691 | 1/1929 | Buttolph | 315/248 X |
| 1,861,620 | 6/1932 | Buttolph | 313/550 X |
| 2,027,519 | 1/1936 | Davis et al. | 313/550 X |
| 3,336,502 | 8/1967 | Gilliatt | 313/547 X |
| 3,851,214 | 11/1974 | Young | 313/547 |
| 3,859,555 | 1/1975 | Latassa et al. | 313/547 |
| 4,262,231 | 4/1981 | Anderson et al. | 313/550 |

*Primary Examiner*—Saxfield Chatmon, Jr.

*Attorney, Agent, or Firm*—William H. Steinberg; James C. Davis, Jr.; Marvin Snyder

[57] ABSTRACT

To provide mercury vapor control in a compact, solenoidal electric field (SEF) lamp there is provided a means for controllably heating a length of conductive material disposed within the lamp envelope so as to thereby heat an amalgam patch on the material. In this way, mercury vapor pressure is controlled within the lamp, not only during lamp operation but also under lamp starting conditions.

10 Claims, 5 Drawing Figures

AMALGAM HEATING SYSTEM FOR SOLENOIDAL ELECTRIC FIELD LAMPS

BACKGROUND OF THE INVENTION

This invention relates to solenoidal electric field lamps and, in particular, to such lamps containing one or more patches of amalgam material for the control of mercury vapor pressure.

In general, the efficacy of fluorescent lamps is a function of the mercury vapor pressure within the lamp envelope. This pressure in turn is usually a function of the coldest part of the lamp envelope. However, more recently developed solenoidal electric field (that is, SEF) lamps are more compact than conventional, tubular fluorescent lamps having the same power rating. In these SEF lamps, the coldest temperature spot on the envelope wall is generally higher than desirable for optimum lamp efficacy. This is due to the fact that the higher minimum wall temperature increases the mercury vapor pressure.

One solution to this problem is to place a material which amalgamates with mercury in the lamp envelope. For a further discussion on amalgams and amalgam positioning within SEF lamps, see U.S. Pat. No. 4,262,231, issued Apr. 14, 1981 to John M. Anderson and Peter D. Johnson. This patent provides a detailed discussion of temperature distribution within SEF lamps and, accordingly, it is hereby incorporated herein by reference, as background material.

One of the materials which is employed as a mercury amalgam is indium. At any given temperature, mercury vapor pressure over the mercury-indium amalgam is lower than mercury vapor pressure over a pool of pure mercury at the same temperature. The temperature of the amalgam "pool" may therefore be used to control mercury vapor pressure.

The presence of the amalgam material reduces the mercurey vapor pressure in a hot lamp but, however, it also unfortunately reduces the mercury vapor pressure when the lamp is cool, that is, at room temperature (20° C., for example). This creates two problems. First, the lamp starting voltage is increased and second, the lamp efficacy is decreases until the amalgam is brought up to lamp operating temperature.

In some conventional fluorescent lamps, this problem is solved by placing some of the amalgam-forming material at a location within the lamp where it can be heated quickly by some part of the lamp. For example, in conventional fluorescent lamps, some amalgam-forming material may be placed on a ring formed around at least one of the electrodes. The heat dissipated by the electrode heats the ring and quickly brings the mercury amalgam to the desired temperature. The heated ring quickly supplies mercury vapor for the lamp discharge. Under steady state conditions, the amalgam on the heated ring is typically too hot for optimum lamp efficacy and mercury pressure control is automatically transferred to a second mecury amalgam location. Such a system is described on pages 59–60 of "Fluorescent Lamps" by W. Elenbass (McMillan Press Ltd., London, 1971). While such a method is satisfactory for mercury vapor pressure control in lamps having heated electrodes, it is not applicable to the electrodeless discharge configuration found in SEF lamps. In such lamps there are no heated electrodes.

The utility of amalgam heating in fluorescent lamp structures also appears to have been appreciated in U.S. Pat. No. 3,336,502, issued to Leland W. Gilliatt. However, this patent only appears to disclose an external means for heating amalgams in particular types of fluorescent lamps. There is no appreciation of the particular problems presented by the compact SEF lamp structure and design. Furthermore, in U.S. Pat. No. 3,898,511, there is also apparently disclosed a mercury amalgam heating system in which the amalgam is activated by heat radiated from lamp electrodes.

SUMMARY OF THE INVENTION

In accordance with a preferred embodiment of the present invention, an SEF lamp comprises an evacuable, light-transmissive envelope having an ionizable medium including mercury contained therein, means for producing a solenoidal electric field within the lamp envelope and lastly, and most importantly, means for controllably heating a length of conductive material disposed within the envelope, the conductive material having at least one amalgam patch thereon. In one embodiment of the present invention, the length of conductive material is heated directly through resistive heating of the material which may be connected to an external electrical energy source via lamp feed-throughs. In another embodiment of the present invention, the length of conductive material is disposed in a loop which links the time varying magnetic field which is employed to provide the solenoidal electric field. Furthermore, an additional amalgam patch located within the envelope other than on the conductive strip may also be employed. The present invention is equally applicable to two forms of SEF lamps: the internally-driven lamp in which the source of the solenoidal electric field is contained within the discharge medium and the externally-driven lamp in which the solenoidal electric field source is typically disposed within an external cavity of the lamp envelope.

Accordingly, it is an object of the present invention to provide a means for heating an amalgam material disposed within an SEF lamp.

It is also an object of the present invention to more quickly bring the lamp to steady state operating conditions characterized by a high degree of lamp energy efficiency.

It is a further object of the present invention to provide SEF lamps having easy starting characteristics.

It is also an object of the present invention to provide a means for directly controlling the mercury vapor pressure within an SEF lamp.

DESCRIPTION OF THE FIGURES

The subject matter which is regarded as the invention is particularly pointed out and distinctly claimed in the concluding portion of the specification. The invention, however, both as to organization and method of practice, together with further objects and advantages thereof, may best be understood by reference to the following description taken in connection with the accompanying drawings in which:

DETAILED DESCRIPTION OF THE INVENTION

Figure 1:
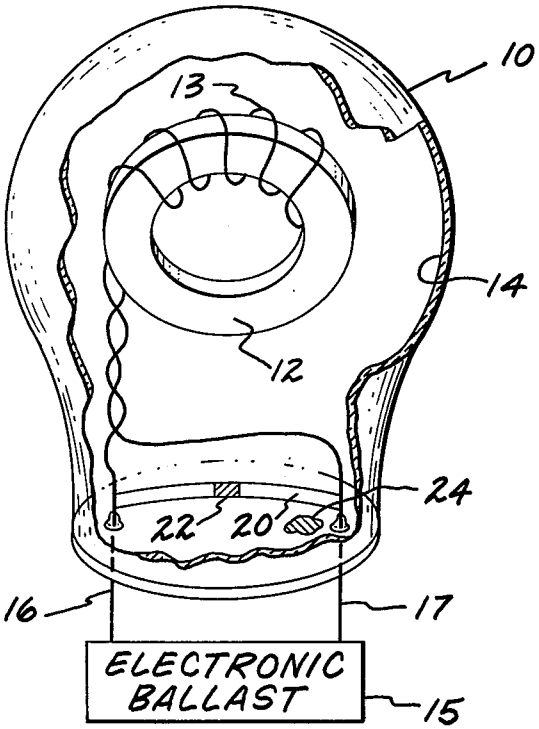
FIG. 1 is an isometric, partially sectional view of an embodiment of the present invention employing electrical feed-throughs.

FIG. 1 illustrates one embodiment of the present invention in which an SEF lamp has a conductive, amalgam containing strip connected directly across the leads supplying electrical energy to a ferrite toroid mounted in the lamp. Specific details of the method for mounting a ferrite core within the lamp are not germane to the present invention. However, such structures are more particularly disclosed in U.S. Pat. No. 4,176,296, issued Nov. 26, 1979 to John M. Anderson. This patent is hereby incorporated herein by reference, as background material for the details of core mounting within internally-driven SEF lamps.

In particular, FIG. 1 illustrates an SEF lamp having envelope 10 which comprises an evacuable light-transmissive material, such as glass. Disposed within evacuable envelope 10 is core 12 preferably comprising a magnetic material such as ferrite. Also, disposed within envelope 10 is an ionizable discharge medium including mercury vapor. Disposed about core 12 is winding 13 which is preferably disposed at the top of core 12 as shown. For a discussion of core turn windings, see U.S. Pat. No. 4,070,602, issued Jan. 24, 1978 to Armand P. Ferro and Harold A. Gauper. Winding 13 is connected by means of lamp feed-through leads 16 and 17 to electronic ballast 15 which supplies high frequency alternating current to winding 13 and ultimately to the plasma discharge current flowing through and around core 12. In general, the preferable operating frequency is in excess of 20 KHZ. In addition, for the production of visible wavelength radiation, phosphor coating 14 is preferably disposed on the interior wall of envelope 10.

In accordance with the present invention, there is also disposed within the lamp conductive strip 20 having an amalgam patch 22 disposed thereon in at least one position along the strip. The strip is connected directly across the portions of lead 16 and 17 which pass through the base wall of envelope 10. Conductive strip 20 may be formed from a single type of resistive material. However, improved operation is generally obtained if the majority of the strip comprises a relatively low resistivity material while the portion of the strip adjacent to or beneath the amalgam patch or patches is formed from a higher resistivity material. This serves to concentrate the heating power in the most useful location. If the conducting strip is connected between the two main leads 16 and 17, heating power is proportional to the square of the voltage applied to the lamp primary. Since approximately three times the normal running voltage is applied to the lamp primary during the starting phase, by ballast 15, the amalgam heating power is nine times its normal (operating) value until the discharge is initiated.

Additional advantages are obtained if the conductive strip is formed from a material which increases in resistance as its temperature increases. Since the power dissipated in the conducting strip varies as $V^2/R$, where R is the resistance of the strip and V is the lamp voltage, the amalgam heating system can be designed to rapidly heat the amalgam when it is cold, yet have minimal power dissipation after the amalgam has been brought up to operating temperature.

Figure 2:
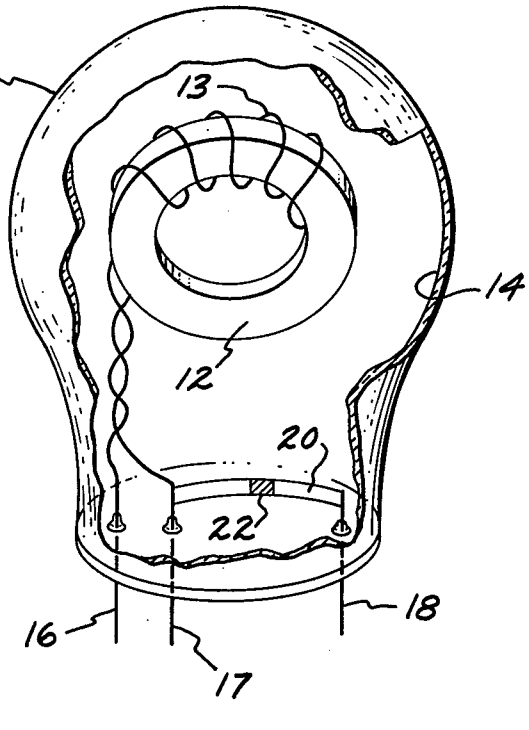
FIG. 2 is a view similar to FIG. 1 except that a single extra feed-through connection is provided for heating the amalgam strip.

The advantages of employing material, for the conductive strip, which has a temperature-dependent resistance, as described above, can also be obtained by employing an embodiment of the present invention such as that illustrated in FIG. 2. In FIG. 2, conductive strip 20 is connected to one of the main feed-through connections, for example, lead 17 and is also additionally connected to a separate lead 18 which is also fed through the base wall of envelope 10. In this embodiment, the conductive strip is heated by a separate circuit in the ballast. The amalgam heating power is then applied when the mercury vapor pressure is low due to a low temperature amalgam and the heating power may then be removed after the amalgam has been brought up to the desired operating temperature. One way for the ballast to determine the amalgam temperature is to measure the lamp operating voltage. Low mercury pressure produces low lamp operating voltage. Another method is to measure the resistance of the conductive strip particularly if temperature-dependent material is used. The choice between using one main feed-through with one auxiliary feed-through lead or using two auxiliary feed-through leads, such as leads 18 and 19 in FIG. 3, depends upon whether the amalgam heating circuit can share a common terminal with the lamp circuit.

Figure 5:
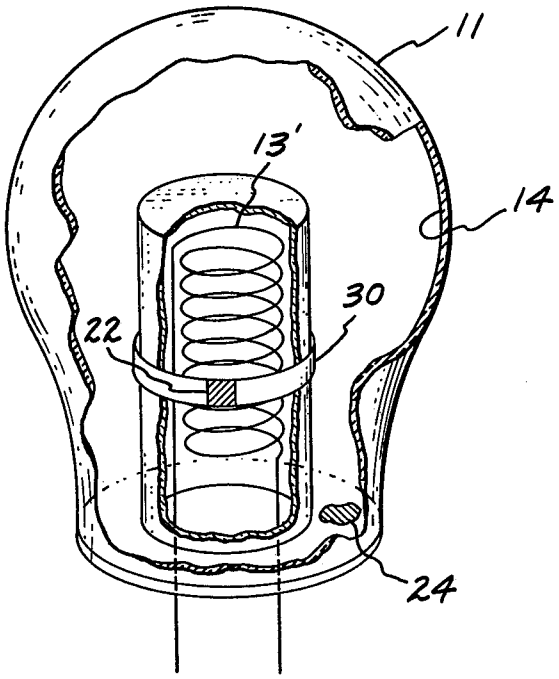
FIG. 5 is an embodiment of the present invention similar to FIG. 4, more particularly illustrating the applicability of the present invention to exteriorally excite driven SEF lamps.
Figure 4:
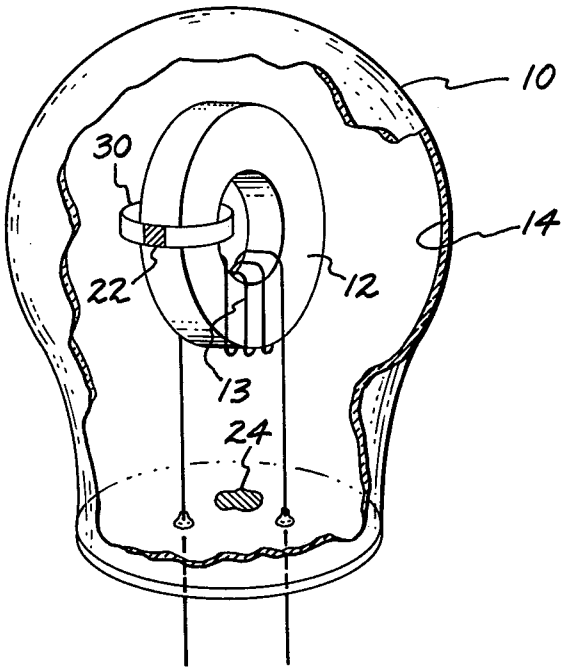
FIG. 4 illustrates an embodiment of the present invention in which the conductive strip is in the form of a loop disposed through the toroidal core of the lamp.

With respect to FIGS. 1, 4 and 5, it should also be noted that there is shown second amalgam patch 24 located on the interior of the envelope wall. Such a second patch is most appropriate in the embodiments illustrated, since in these embodiments power to conductive strip 20 cannot be totally independently controlled after lamp starting. Since some control is therefore lacking, there is a significant likelihood that such amalgam patches may operate, during normal running conditions, at higher than desirable temperatures, thereby permitting the conventionally employed amalgam heating and mercury vapor pressure control systems to take over.

It should also be noted here that since similar structures shown in FIGS. 1–5 possess the same reference numeral, further discussion in FIGS. 2–5 would be unnecessarily repetitious.

FIG. 4 illustrates another embodiment of the present invention in which conductive strip 30 is disposed in the form of a loop surrounding core 12. Conductive loop 30 forms a one-turn secondary winding magnetically coupled with energizing winding 13. In this way, energy may be supplied to conductive loop 30 without the necessity of having an additional feed-through in the envelope wall. Again, it is preferred that, in such an embodiment, the conductive strip 30 possess low resistivity except in the area below and/or immediately adjacent to the amalgam patch or patches disposed on the loop.

FIG. 5 illustrates another embodiment of the present invention similar to that shown in FIG. 4 except that a different envelope 11 is provided which possesses an external cavity or indentation for the receipt of an energizing coil 13'. This is the typical structure found in externally-driven SEF lamps. The embodiment of FIG. 5 particularly illustrates the fact that the present invention may be employed in a manner in which no feed-throughs in the wall of the envelope are required. Thus, in FIGS. 4 and 5 there is provided an inductively heated amalgam means which is particularly applicable and valuable for use in SEF lamps. Since some SEF lamps do not employ electrical feed-throughs, the induction coupling method illustrated in FIG. 5 is a convenient means of supplying power to heat the amalgam. Furthermore, the inductively-heated amalgam structure is equally applicable to SEF lamps in which a core such as ferrite is mounted directly in the discharge environment.

The SEF lamp embodiments illustrated herein in FIGS. 1–5 are merely exemplary of SEF lamp configurations in which the present invention may be employed. There are many forms such lamps may take without detracting from the usefulness of the present invention or from its applicability for employment therein. For example, and not limitation, several SEF lamp structures are considered below.

In U.S. Pat. No. 4,180,703, issued Dec. 25, 1979 to John M. Anderson, an SEF lamp geometry is disclosed in which toroidal cores surround a toroidal discharge envelope. The cores, typically ferrite, link the envelope and produce the desired solenoidal electric field. In such an SEF lamp design, a conductive strip loop with an amalgam patch is preferably disposed within the toroidal envelope arounds its inner periphery, as opposed to being oriented interiorally in the same fashion as the toroidal cores are disposed exteriorally.

In a lamp such as is shown in FIG. 5, it is also possible to dispose winding 13' within the lamp. Whether winding 13' is disposed interiorally or exteriorally, strip 30 is still employable in the manner indicated. Such a lamp may also include a ferrite rod disposed within the cavity, again whether coil 13' is inside or outside the envelope. Still another SEF lamp configuration in which the present invention may be employed comprises an envelope having no external cavity but with an internal coil having external feed-through connections. Such a lamp may also include a ferrite rod core within the envelope and within the coil.

Figure 3:
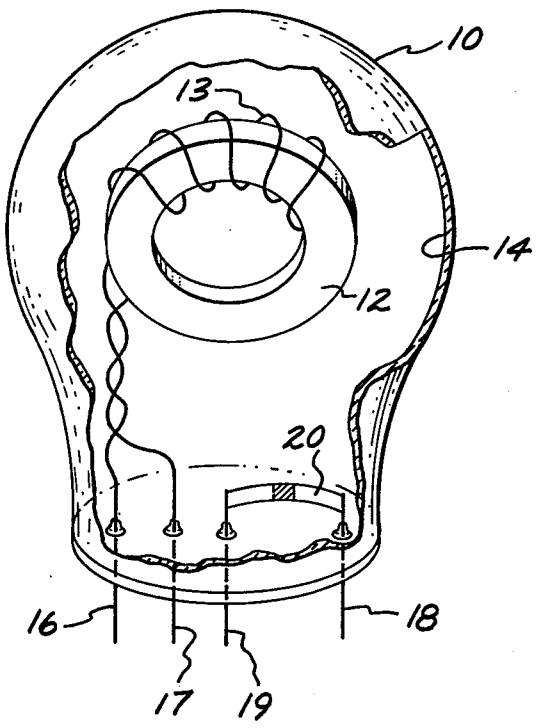
FIG. 3 is a view similar to FIG. 2 except that heating of the conductive strip is now independent of the electrical power supply to the solenoidal electric field energy source.

Another SEF lamp variation is also illustrated in U.S. Pat. No. 4,117,378, issued Sept. 26, 1978 to Homer H. Glascock, Jr. This lamp is topologically similar to the lamp in U.S. Pat. No. 4,180,763, especially since the completed lamp envelope in the Glascock patent is also, topologically, a toroid. It has advantages of no electrical feed-through connections and positioning of a ferrite core externally to the lamp. The present invention is, nonetheless, employable therein either as a loop such as seen in FIGS. 4 or 5, or as a heated strip (with feed-throughs) as seen in FIGS. 1, 2 or 3. The loop is, however, the preferred embodiment for this form of SEF lamp, to avoid having to provide feed-through connections.

In the present invention, the amalgam material disposed in a patch on the conductive strip, may be any convenient amalgam generally employed in fluorescent lamps. This amalgam material may include, for example, indium or the lead-tin-bismuth alloy disclosed in above-mentioned U.S. Pat. No. 4,262,231.

From the above it should be appreciated that the present invention provides an amalgam heating system employing conventional materials which makes for easy starting of solenoidal electric field lamps but yet which is adaptable to automatic pressure regulation of mercury vapor in the lamp for optimal control of lamp efficacy. It is also seen that the present invention is equally applicable both to SEF lamps which are internally driven and to those which are externally driven.

While the invention has been described in detail herein in accord with certain preferred embodiments thereof, many modifications and changes therein may be effected by those skilled in the art. Accordingly, it is intended by the appended claims to cover all such modifications and changes as fall within the true spirit and scope of the invention.

The invention claimed is:

1. A solenoidal electric field lamp comprising:

an evacuable, light transmissive envelope having an ionizable medium including mercury vapor, disposed therein;

means for providing a solenoidal electric field within said envelope, said means comprising a core being coupled to an external alternating current power source through a winding disposed on said core, said winding coupled to the exterior of said envelope through a pair of wire leads;

a length of conductive material disposed within said envelope; and an amalgam patch situated on said conductive material, said length of conductive material electrically connected to said pair of wire leads so that automatically variable control of the heat supplied said amalgam patch is achieved during lamp operation, rapid heating of said amalgam occuring due to high starting voltages applied to said core, and reduced heating of said amalgam patch after lamp starting due to lower lamp operating voltages.

2. The lamp of claim 1 in which said conductive material has a region of relatively high electrical resistance along its length, with at least one amalgam patch being disposed on said material in proximity to at least part of said high resistance region.

3. The lamp of claim 1 in which said lamp includes an additional amalgam patch located within said envelope, other than on said conductive strip.

4. The lamp of claim 1 in which a phosphor coating is disposed on the interior of said envelope.

5. The lamp of claim 1 in which said conductive material exhibits temperature dependency characteristic characterized by resistance which increases with temperature.

6. A solenoidal electric field lamp comprising:

an evacuable, light-transmissive envelope having an ionizable medium including mercury vapor, disposed therein;

means for providing a solenoidal electric field within said envelope, said means comprising a core being coupled to an external alternating current source through a winding disposed on said core, said winding coupled to the exterior of said envelope through a pair of wire leads;

a length of conductive material formed in a loop linking the core, so that during lamp operation the time varying magnetic field which drives the discharge current in the lamp also causes a current to flow in said conductive loop; and an amalgam patch situated on said conductive material, so that automatically variable control of the heat supplied said amalgam patch is achieved during lamp operation, with rapid heating of said amalgam patch disposed on said conductive loop due to the high starting voltage applied to said core by said external alternating current source and reduced heating of the amalgam patch after lamp starting due to the lower voltage provided to the core after starting because of the solenoidal electric field lamp operating characteristic.

7. The lamp of claim 6 in which said conductive material has a region of relatively high electrical resistance along its length, with at least one amalgam patch being disposed on said material in proximity to at least part of said high resistance region.

8. The lamp of claim 6 in which said lamp includes an additional amalgam patch located within said envelope, other than on said conductive strip.

9. The lamp of claim 6 in which a phosphor coating is disposed on the interior of said envelope.

10. The lamp of claim 6 in which said conductive material exhibits temperature dependency characteristic characterized by resistance which increases with temperature.

* * * * *